US007158102B2

(12) United States Patent
Hansen et al.

(10) Patent No.: US 7,158,102 B2
(45) Date of Patent: Jan. 2, 2007

(54) SYSTEM AND METHOD FOR RECALIBRATING FLAT PANEL FIELD EMISSION DISPLAYS

(75) Inventors: Ronald L. Hansen, San Jose, CA (US); James C. Dunphy, San Jose, CA (US); Christopher J. Spindt, Menlo Park, CA (US); James M. Cleeves, Redwood City, CA (US); Jerome M. Truppa, San Jose, CA (US); Gregory M. Fink, San Jose, CA (US); Yukinobu Iguchi, Mizunami (JP)

(73) Assignees: Candescent Technologies Corporation, San Jose, CA (US); Sony Corporation, Tokyo (JP)

( * ) Notice: Subject to any disclaimer, the term of this patent is extended or adjusted under 35 U.S.C. 154(b) by 179 days.

(21) Appl. No.: 10/133,161

(22) Filed: Apr. 26, 2002

(65) Prior Publication Data

US 2003/0201954 A1 Oct. 30, 2003

(51) Int. Cl.
*G09G 3/20* (2006.01)
*G09G 3/22* (2006.01)

(52) U.S. Cl. ..... 345/75.2; 345/904

(58) Field of Classification Search ..... 345/75.2, 345/74.1, 73, 75.1, 904, 72
See application file for complete search history.

(56) References Cited

U.S. PATENT DOCUMENTS 5,216,504 A 6/1993 Webb et al. ..... 358/139
5,659,328 A * 8/1997 Todokoro et al. ..... 345/74.1
5,700,175 A * 12/1997 Wang et al. ..... 445/24
5,708,451 A 1/1998 Baldi ..... 345/75
6,060,840 A 5/2000 Foo et al. ..... 315/169.1
6,097,356 A 8/2000 Fan ..... 345/60
6,307,327 B1 10/2001 Xie et al. ..... 315/169.4
6,429,835 B1 * 8/2002 Browning et al. ..... 345/74.1
6,445,367 B1 * 9/2002 Suzuki et al. ..... 345/75.2
6,465,966 B1 10/2002 Konuma ..... 315/169.1
6,492,781 B1 12/2002 Palmer et al. ..... 315/307
6,542,136 B1 * 4/2003 Smith ..... 345/75.2
6,580,407 B1 * 6/2003 Suzuki et al. ..... 345/74.1
6,621,475 B1 * 9/2003 Yamaguchi et al. ..... 345/74.1
6,636,002 B1 * 10/2003 Kim ..... 315/169.3

* cited by examiner

*Primary Examiner*—Richard Hjerpe
*Assistant Examiner*—Kevin M. Nguyen
(74) *Attorney, Agent, or Firm*—Ladas & Parry LLP

(57) ABSTRACT

A field emission display (FED) having a correction system with a correction coefficient derived from emission current is presented. Within one embodiment in accordance with the present invention, a field emission display has an anode at the faceplate and a focus structure. The anode potential is held at ground while the focus structure potential is held between, but is not limited to, 40 and 50 volts. The current flowing to the focus structure is measured and used as the basis for the correction coefficient for the field emission display.

3 Claims, 13 Drawing Sheets

SYSTEM AND METHOD FOR RECALIBRATING FLAT PANEL FIELD EMISSION DISPLAYS

TECHNICAL FIELD

The present invention relates to the field of display screens. More specifically, the present invention relates to the field of, but is not limited to, flat panel field emission displays (FEDs) and/or cathode ray tube (CRT) displays.

BACKGROUND ART

Flat panel field emission displays (FEDs), like standard cathode ray tube (CRT) displays, generate light by impinging high-energy electrons on a picture element (pixel) of a phosphor screen. The excited phosphor then converts the electron energy into visible light. However, unlike conventional CRT displays that use a single or in some cases three electron beams to scan across the phosphor screen in a raster pattern, FEDs use stationary electron beams for each color element of each pixel. This allows the distance from the electron source to the screen to be very small compared to the distance required for the scanning electron beams of the conventional CRTs. In addition, the vacuum tube of the FED can be made of glass much thinner than that of conventional CRTs. Moreover, FEDs consume far less power than CRTs. These factors make FEDs ideal for portable electronic products such as laptop computers, pocket-TVs and portable electronic games.

As mentioned, FEDs and conventional CRT displays differ in the way the image is scanned. Conventional CRT displays generate images by scanning an electron beam across the phosphor screen in a raster pattern. Typically, as the electron beam scans along the row (horizontal) direction, its intensity is adjusted according to the desired brightness of each pixel of the row. After a row of pixels is scanned, the electron beam steps down and scans the next row with its intensity modulated according to the desired brightness of that row. In marked contrast, FEDs usually generate images according to a "matrix" addressing scheme. Each electron beam of the FED is formed at the intersection of individual rows and columns of the display. Rows are updated sequentially. A single row electrode is activated alone with all the columns active, and the voltage applied to each column determines the strength of the electron beam formed at the intersection of that row and column. Then, the next row is subsequently activated and new brightness information is set again on each of the columns. When all the rows have been updated, a new frame is displayed.

However, the electronic structures forming the beam for each pixel in a FED are not necessarily uniform. Because of variations during manufacturing, different pixels may generate different intensities when given the same input. What is needed is a system for measuring and correcting the non-uniform pixels without relying on external optical equipment and/or making measurements at higher operating voltages.

SUMMARY OF THE INVENTION

The present invention provides a system and method for measuring and correcting the non-uniform pixels of a display device without relying on external optical equipment and/or making measurements at higher operating voltages.

Specifically, a flat panel field emission display (FED) having a correction system with a correction coefficient derived from emission current is presented. In one embodiment in accordance with the present invention, a FED has an anode at the faceplate and a focus structure. The anode potential is held at ground while the focus structure potential is held between, but is not limited to, 40 and 50 volts. The current flowing to the focus structure is measured and used as the basis for the correction coefficient for the field emission display.

In another embodiment, the present invention provides a display correction system. The display correction system includes a current measurement system coupled to a component of a field emission display for producing a current measurement. Additionally, the display correction system includes a computation system coupled to receive the current measurement from the current measurement system for producing a correction coefficient. It is appreciated that the correction coefficient is utilized to produce a corrected video signal from an uncorrected video input signal for the field emission display.

In yet another embodiment, the present invention provides a display correction system as described in the previous paragraph wherein the component of the field emission display is selected from a cathode driver, a gate driver, a focus structure and an anode driver.

In still another embodiment, the present invention provides a method of evaluating a correction coefficient in a field emission display. The method includes applying an input pattern to the field emission display. Furthermore, the method includes determining a current measurement from a component of the field emission display. The method also includes determining the correction coefficient utilizing the current measurement. Moreover, the method includes utilizing the correction coefficient to produce a corrected video signal from an uncorrected video input signal for the field emission display.

In yet another embodiment, the present invention provides a method as described in the previous paragraph wherein the component of the field emission display is selected from a cathode driver, a gate driver, a focus structure and an anode driver.

In another embodiment, the present invention provides a display correction system for producing a corrected video signal from an uncorrected video input signal for a field emission display. The display correction system includes means for determining a current measurement from a component of the field emission display. Additionally, the display correction system includes means for determining a correction coefficient utilizing the current measurement. The display correction system also includes means for utilizing the correction coefficient to produce the corrected video signal from the uncorrected video input signal for the field emission display.

In yet another embodiment, the present invention provides a display correction system as described in the previous paragraph wherein the component of the field emission display is selected from a cathode driver, a gate driver, a focus structure and an anode driver.

In another embodiment in accordance with the present invention, the FED's anode and focus structure are held at ground. The gate potential is held between, but is not limited to, 40 and 50 volts. A test pattern is applied that activates a pixel. The current flowing to the gate is measured and is used as the basis for a correction coefficient for that pixel.

In yet another embodiment in accordance with the present invention, the FED is configured with normal operating voltages. A test pattern is applied that activates a single pixel. The current flowing to the anode is measured. A correction coefficient is derived and used in a correction system. The correction system has a coefficient memory holding the correction coefficient. The correction coefficient is used to scale each component of the incoming video signal. The corrected signals are then provided to the FED.

In still another embodiment in accordance with the present invention, the FED is configured with normal operating voltages. A test pattern is applied that activates a single sub-pixel. The current flowing to the anode is measured. A correction coefficient is derived and used in a correction system. The correction system has a coefficient memory holding the correction coefficient. The correction coefficient is used to scale the color component of the incoming video signal corresponding to the sub-pixel. A separate correction coefficient is provided for each sub-pixel. The corrected signals are then provided to the FED.

In another embodiment in accordance with the present invention, the FED has the anode held at ground potential. The focus structure is held at, but is not limited to, approximately 40 to 50 volts potential. A test pattern is applied that activates several pixels concurrently. The current to the focus structure is measured and used as a basis for computing a correction coefficient. The correction coefficient is applied to the data corresponding to the pixels in a correction system.

In yet another embodiment in accordance with the present invention, a correction coefficient is retrieved from a coefficient memory. The retrieved coefficient is applied to an analog luminance signal by converting the correction coefficient into an analog voltage and multiplying that voltage by the analog luminance signal. The resulting corrected luminance signal may then be utilized to drive a cathode ray tube (CRT) display.

These and other advantages of the present invention will no doubt become obvious to those of ordinary skill in the art after having read the following detailed description of the embodiments that are illustrated in the drawing figures.

BRIEF DESCRIPTION OF THE DRAWINGS

The accompanying drawings, which are incorporated in and form a part of this specification, illustrate embodiments of the present invention and, together with the description, serve to explain the principles of the invention.

The drawings referred to in this description should not be understood as being drawn to scale except if specifically noted.

DETAILED DESCRIPTION OF THE INVENTION

Reference will now be made in detail to the present embodiments of the invention, examples of which are illustrated in the accompanying drawings. While the invention will be described in conjunction with the present embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description, for purposes of explanation, numerous specific details are set forth in order to provide a thorough understanding of the present invention. It will be apparent, however, to one skilled in the art, upon reading this disclosure, that the present invention may be practiced without these specific details. In other instances, well-known structures and devices are not described in detail in order to avoid obscuring aspects of the present invention.

Figure 1:
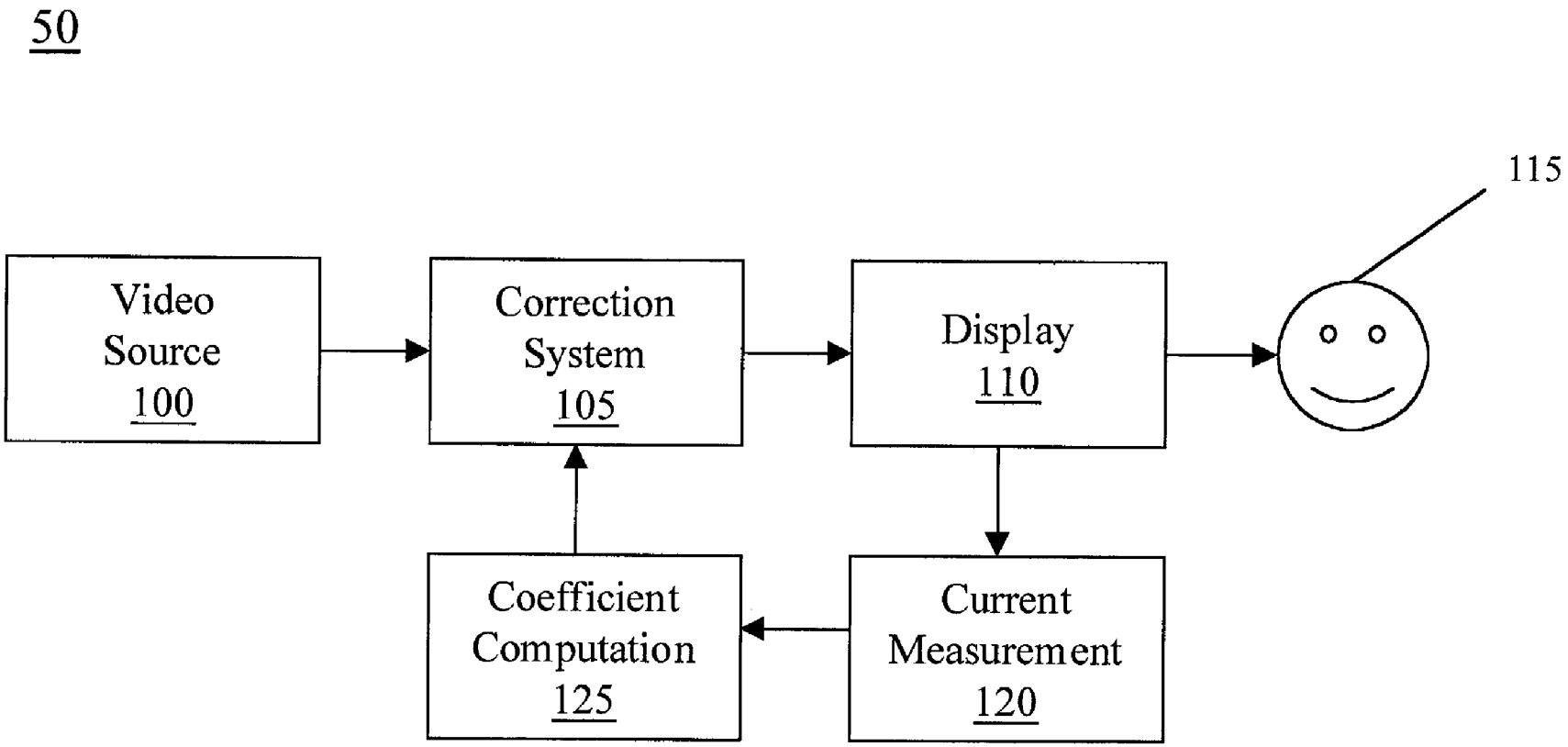
FIG. 1 is a block diagram of a system that illustrates the relationship between a correction system, a display and sub-systems for determining correction coefficients in accordance within an embodiment of the present invention.

FIG. 1 is a block diagram of a system 50 that illustrates the relationship between a correction system 105, a display 110 and sub-systems for determining correction coefficients in accordance within an embodiment of the present invention. Within system 50, a video signal source 100 provides a video signal to a correction system 105. In an embodiment of system 50, the video signal provided by video source 100 may be in the form of a Red-Green-Blue (RGB) signal. In another embodiment of system 50, the video signal provided by video source 100 may be in the form of a luminance-chrominance signal. Upon receiving the video signal provided by video source 100, the correction system 105 scales it with a correction coefficient in order to compensate for non-uniformities within the display 110. The corrected signal output by the correction system 105 then drives display 110 to provide an image to a human user 115. In an embodiment of system 50, the display 110 may be, but is not limited to, a field emission display (FED) or a cathode ray tube (CRT) display.

If the display 110 is implemented as a FED within system 50, the correction coefficient used in the correction system 105 may be obtained by first measuring the emission current in the FED with a current measurement system 120. The coefficient computation system 125 may then compute the correction coefficient from current measurement data through appropriate scaling and offsets against reference currents and base loads within the display 110.

Figure 2:
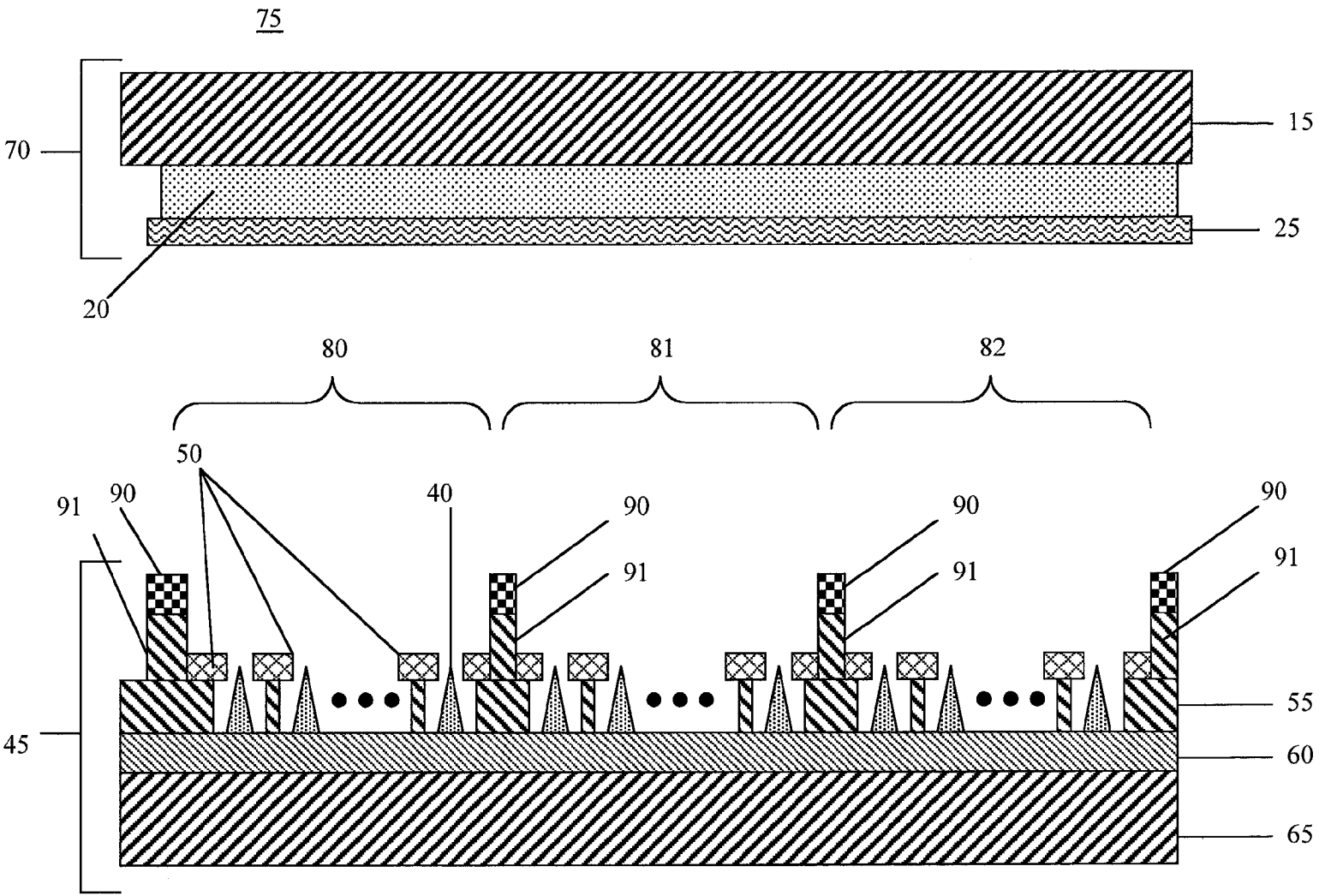
FIG. 2 is a cross section structural view of part of a flat panel field emission display (FED) screen that utilizes a gated field emitter situated at the intersection of a row and a column line in accordance within an embodiment of the present invention.

FIG. 2 is a cross section structural view of part of a flat panel FED screen (e.g., 110) that utilizes a gated field emitter situated at the intersection of a row and a column line in accordance within an embodiment of the present invention. Specifically, FIG. 2 illustrates a multi-layer structure 75 that is a portion of a FED flat panel display (e.g., 110). The multi-layer structure 75 contains a field-emission backplate structure 45, also referred to as a baseplate structure, and an electron-receiving faceplate structure 70. It is understood that an image may be generated by faceplate structure 70. Backplate structure 45 commonly consists of an electrically insulating backplate 65, an emitter (or cathode) electrode 60, an electrically insulating layer 55, a patterned gate electrode 50, and a conical electron-emissive element 40 situated in an aperture through insulating layer 55. Additionally, the tip of the electron-emissive element 40 is exposed through a corresponding opening in gate electrode 50. It is understood that the emitter electrode 60 and electron-emissive element 40 together constitute a cathode of the illustrated portion 75 of the FED flat panel display (e.g., 110). A conducting focus structure 90 is separated from the gate electrodes 50 by an insulating layer 91. Faceplate structure 70 may be formed with an electrically insulating faceplate 15, an anode 25, and a coating of phosphors 20.

One type of electron-emissive element 40 in accordance with the present embodiment is described in U.S. Pat. No. 5,608,283, issued on Mar. 4, 1997 to Twichell et al. and another type is described in U.S. Pat. No. 5,607,335, issued on Mar. 4, 1997 to Spindt et al., which are both incorporated herein by reference. The focus structures 90 in accordance with the present embodiment are described in U.S. Pat. No. 5,528,103 issued on Jun. 18, 1996 to Spindt et al., which is incorporated herein by reference. The general operation of a FED flat panel display (e.g., 110) in accordance with the present embodiment is described in more detail within the following United States Patents: U.S. Pat. No. 5,541,473 issued on Jul. 30, 1996 to Duboc, Jr. et al.; U.S. Pat. No. 5,559,389 issued on Sep. 24, 1996 to Spindt et al.; U.S. Pat. No. 5,564,959 issued on Oct. 15, 1996 to Spindt et al.; and U.S. Pat. No. 5,578,899 issued Nov. 26, 1996 to Haven et al., which are all incorporated herein by reference. Techniques for measuring current emission per pixel in accordance with the present embodiment are described in co-pending U.S. application Ser. No. 09/895,985 filed Jun. 28, 2001 by Cummings et al., which is incorporated herein by reference.

In a FED flat panel display (e.g., 110), the display is divided into picture elements called pixels. In one embodiment in accordance with the present invention, each pixel is divided into three sub-pixels corresponding to the colors red, green and blue. FIG. 2 illustrates the structure of a single pixel broken into three sub-pixels 80, 81 and 82. By varying the voltages and currents at gate 50, cathode 60/40, anode 25 and focus structure 90 at a sub-pixel (e.g., 80, 81 or 82), different intensities of light appear on the faceplate 15 above that sub-pixel. The color for that sub-pixel (e.g., 80, 81 or 82) may be determined by the particular mixture of the phosphorus coating 20 above the gate 50 and cathode 60/40 corresponding to that sub-pixel.

Within the FED (e.g., 110), pixels are arranged in an array of rows and columns. In an embodiment in accordance with the present invention, the sub-pixels (e.g., 80, 81 or 82) corresponding to a pixel are placed in adjacent columns. In one embodiment, the cathode 60/40 is common to all sub-pixels in a given row and the gate 50 is common to all sub-pixels in a given column. In another embodiment, the cathode 60/40 is common to all sub-pixels in a given column and the gate 50 is common to all sub-pixels in a given row. A particular sub-pixel (e.g., 80, 81 or 82) in a given row and column is controlled by the interaction of electrical signals for that row and that column.

Figure 3:
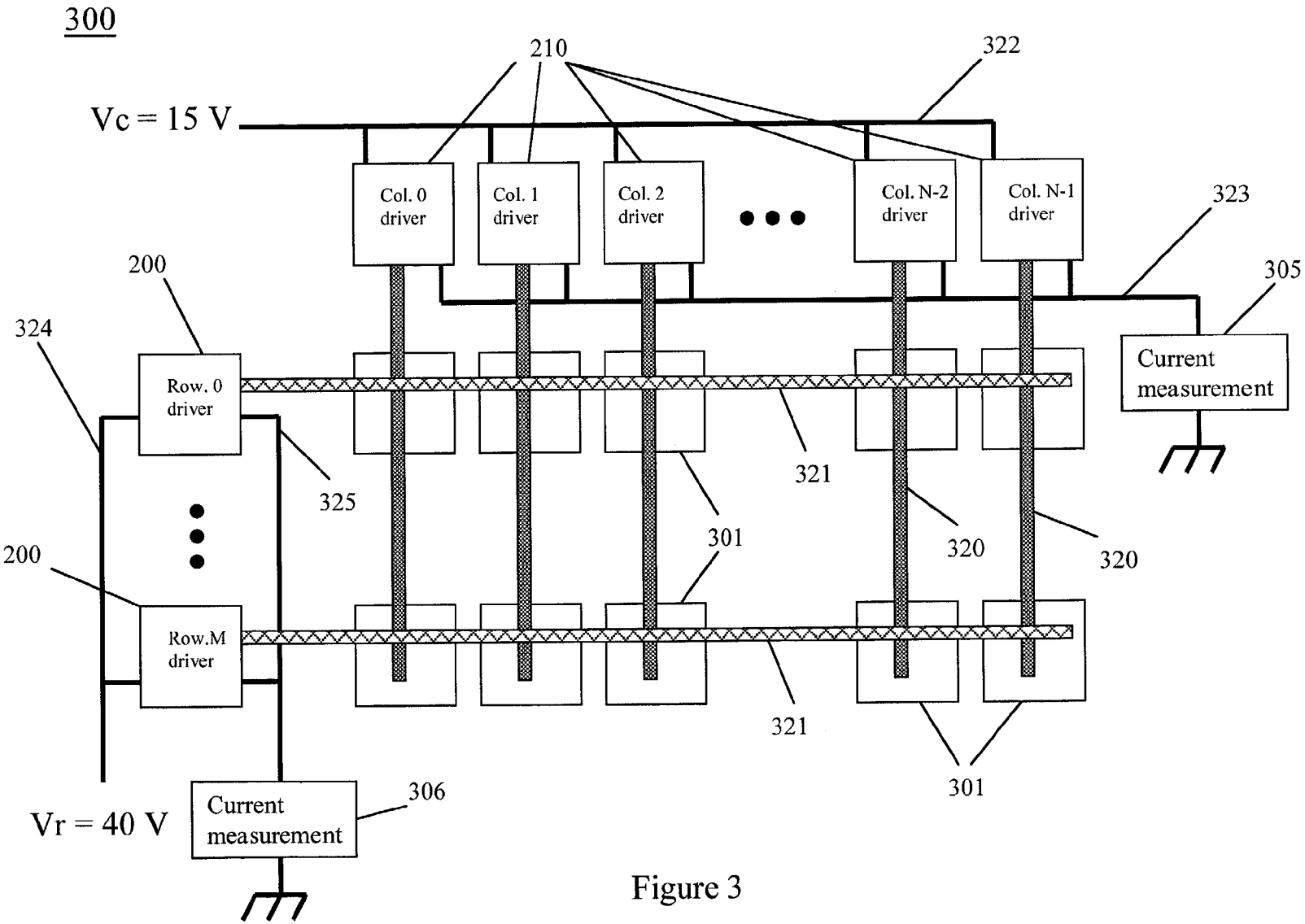
FIG. 3 is a block diagram of a system that includes the distribution of power and control lines for an array of sub-pixels in a FED in accordance within an embodiment of the present invention.

FIG. 3 is a block diagram of a system 300 that includes the distribution of power and control lines for an array of sub-pixels in a FED (e.g., 110) in accordance within an embodiment of the present invention. In this embodiment of system 300, the columns are coupled to the cathodes (e.g., 60/40) and the rows are coupled to the gates (e.g., 50). Specifically, there is a column driver 210 (also referred to as a cathode driver 210) for each column of sub-pixel elements in the array. A column driver line 320 runs through each sub-pixel cell 301 in the same column. Additionally, a row driver line 321 runs through each sub-pixel cell 301 in the same row. Each column driver 210 is operated in parallel with the other column drivers. The column drivers 210 share a column driver voltage line 322 and a column driver return line 323. Each row driver 200 (also referred to as a gate driver 200) is operated in parallel with the other row drivers. The row drivers 200 share a common row driver voltage line 324 and a row driver return line 325. It is appreciated that some embodiments in accordance with the present invention may make use of current measurement devices 306 and/or 305 in the row return line 325 and the column return line 323, respectively.

Figure 4:
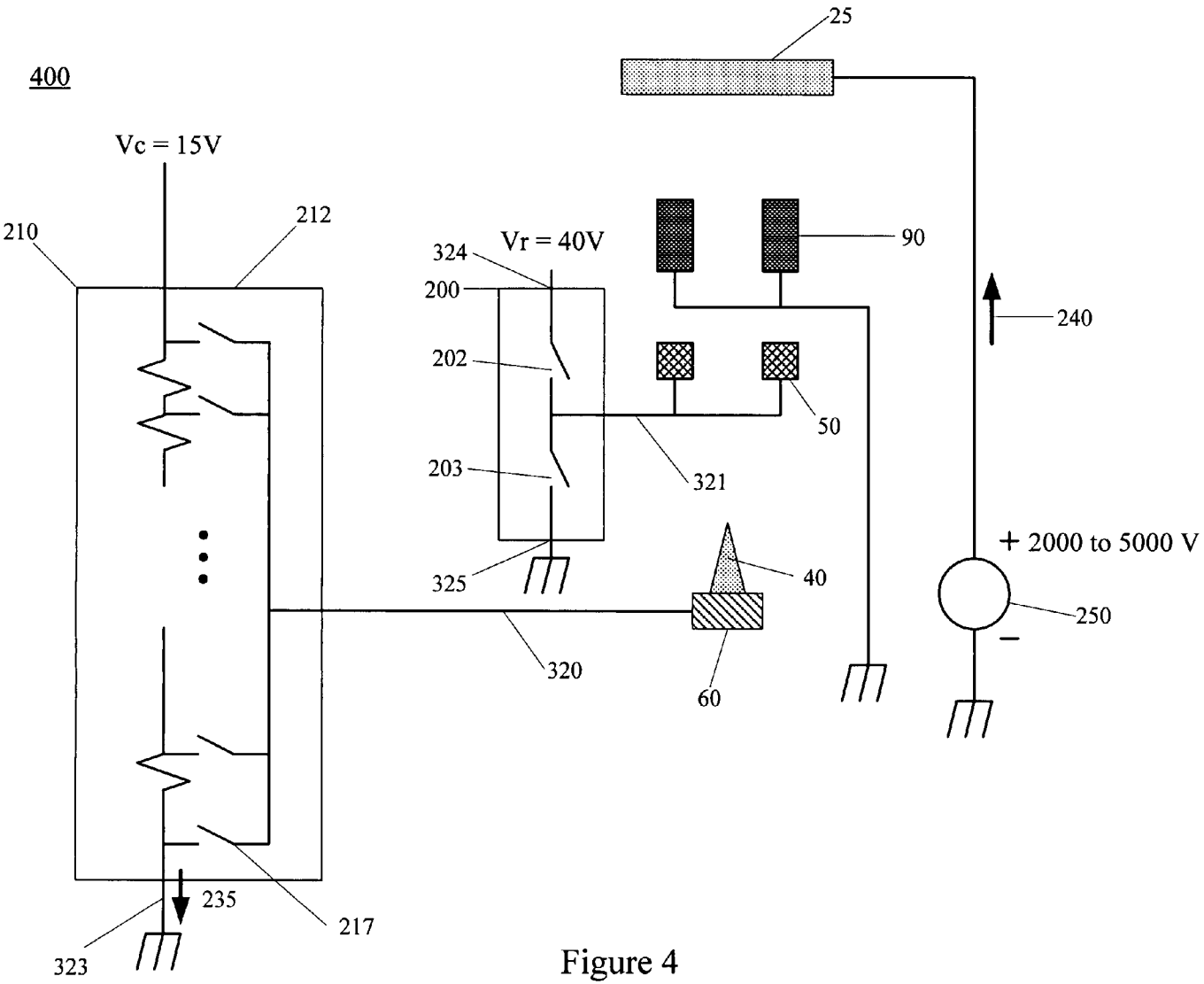
FIG. 4 is a schematic of a system which illustrates how an individual sub-pixel cell may be electrically controlled in accordance with an embodiment of the present invention.

FIG. 4 is a schematic of a system 400 which illustrates how an individual sub-pixel cell (e.g., 301) may be electrically controlled in accordance with an embodiment of the present invention. Within the present embodiment, the row driver 200 is coupled to the gate 50 while column driver 210 is coupled to cathode 60/40. A row is active (and thus capable of providing electrons to illuminate that portion of the faceplate 70) when switch 202 is closed and switch 203 is open.

For each frame, each sub-pixel (e.g., 80, 81 or 82) has a value that describes the desired level of intensity for that sub-pixel. During the time that the row containing a particular sub-pixel is active, the value for that sub-pixel is used to control the column driver 210 for the column containing that sub-pixel. In one embodiment in accordance with the present invention, the value may be a digital quantity that specifies the voltage level. In an alternate embodiment, the value may be an analog value.

Within system 400 of FIG. 4, the column divider 210 may operate as a voltage divider that uses digital logic to close one of a group of switches. For example, for maximum current, the switch 217 may be closed. Conversely, for minimum current, switch 212 may be closed.

In normal operation of the present embodiment, the anode 25 may be set to a relatively high voltage utilizing anode voltage source 250 (also referred to as an anode driver 250). Thus, the anode current 240 would flow through the cathode 60/40 and leave through the column driver 210 as part of current 235. By applying a conventional current measurement technique at either the anode voltage source 250 or at the output of column driver 210, a numerical value for the current may be obtained. It is appreciated that a voltage source coupled to anode 25 may be referred to as an anode driver.

Figure 5:
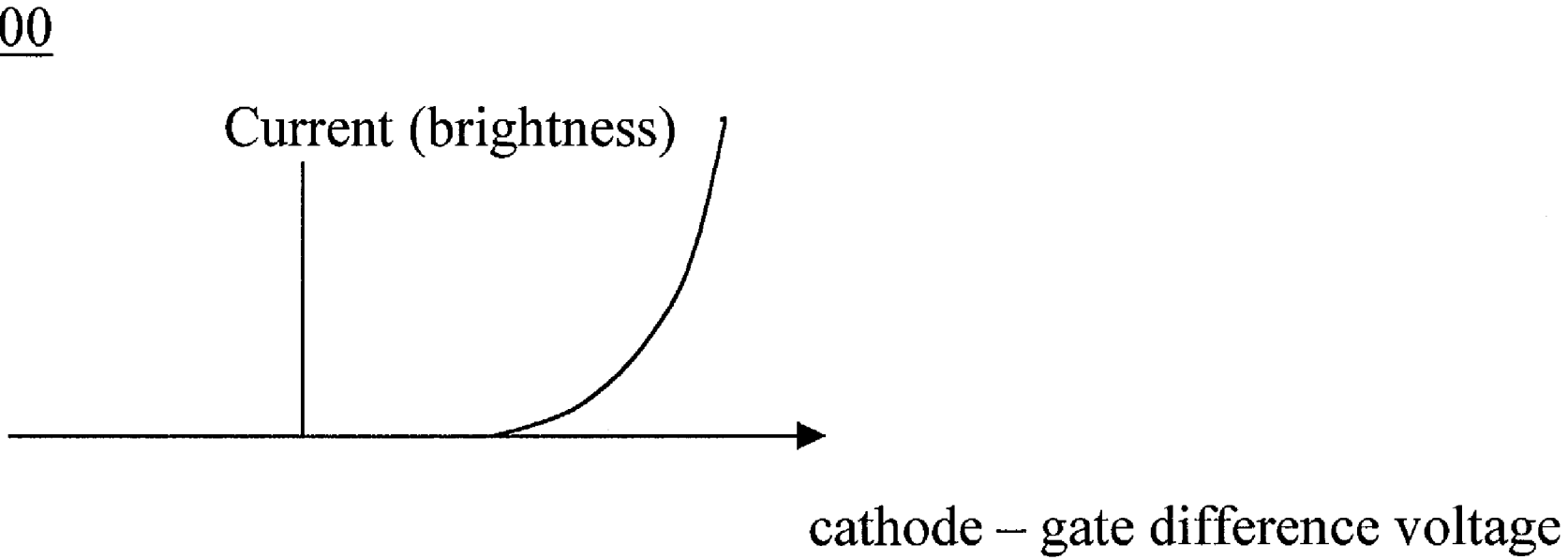
FIG. 5 is a graph that shows the current that flows as a function of the relative voltage between the cathode and the gate in accordance within an embodiment of the present invention.

FIG. 5 is a graph 500 that shows the current that flows as a function of the relative voltage between the cathode (e.g., 60/40) and the gate (e.g., 50) in accordance within an embodiment of the present invention. As shown in graph 500, the brightness of a sub-pixel (e.g., 80, 81 or 82) would be directly related to (i) the current that flows from the cathode (e.g., 60/40) to the anode (e.g., 25) of that sub-pixel and (ii) the duration of the current. The current would be governed by the voltage set in column driver 210 and the voltage of row driver 200. The current duration of the sub-pixel (e.g., 80, 81 or 82) may be controlled by the column driver 210.

In one embodiment in accordance with the present invention, a value is used to set the voltage level in a column driver 210. In another embodiment, a value is used to determine the duration of time that the current is produced by the column driver 210. This alternate embodiment provides a pulse width modulated control for the display (e.g., 110).

Ideally, the current-voltage response shown in graph 500 of FIG. 5 should be the same for every sub-pixel (e.g., 80, 81 or 82) in the FED (e.g., 110). Unfortunately, for a variety of reasons, including problems in manufacturing and aging in the FED (e.g., 110) during its normal operating life, the current-voltage response can vary from sub-pixel (e.g., 80, 81 or 82) to sub-pixel. Accordingly, the same drive value presented at two different sub-pixels may produce different levels of brightness. This difference in levels of brightness may be measured by differences in current. The current for one sub-pixel (e.g., 80, 81 or 82) may be measured by applying a test input pattern that activates only that sub-pixel. The current for the other sub-pixel may be measured with the application of a second pattern to activate the other sub-pixel. With an array of such current measurements, one may determine how to scale the drive value for a particular pixel in order to improve the uniformity of the actual display (e.g., 110).

It is appreciated that circuits for measuring and comparing currents are well known in the art. Therefore, detailed descriptions of those circuits are not discussed herein in order to avoid obscuring aspects of embodiments in accordance with the present invention.

Figure 6:
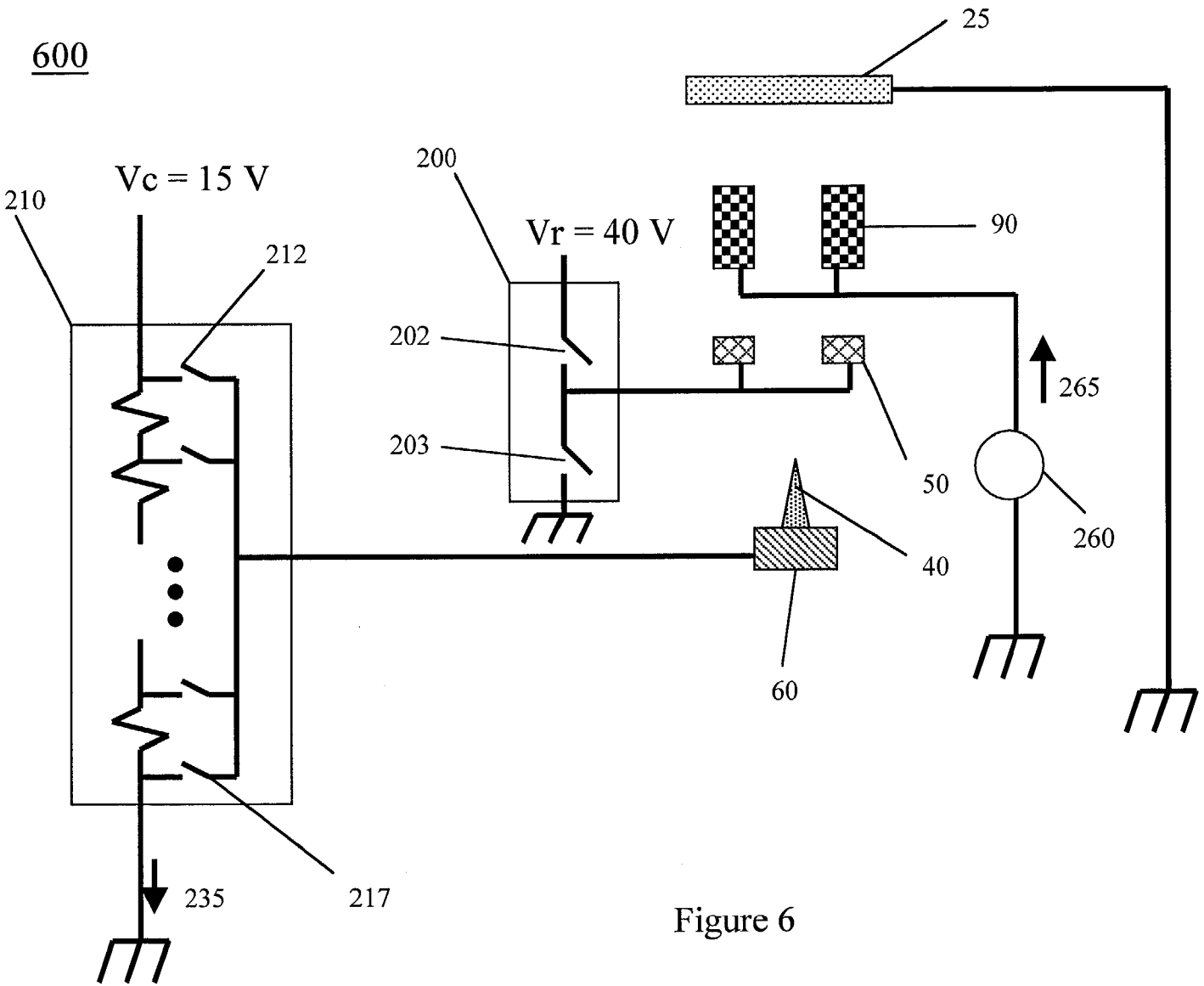
FIG. 6 is a schematic of a system utilized for measuring current through a focus structure in accordance within an embodiment of the present invention.

FIG. 6 is a schematic of a system 600 utilized for measuring current through a focus structure (e.g., 90) in accordance within an embodiment of the present invention. Within the present embodiment, the focus structure 90 may be held at a potential of, but not limited to, 40 to 50 volts by focus structure voltage source 260. Additionally, the anode 25 may be held at ground. It is appreciated that a ground potential coupled to anode 25 may be referred to as an anode driver. Focus structure current 265 flows through the cathode 60/40 and out of the column driver 210 as part of column driver current 235. Because the voltages of the present embodiment are much lower than the typical voltages used to generate an image on the faceplate (e.g., 70), less sophisticated current measurement circuitry may be used.

Figure 7:
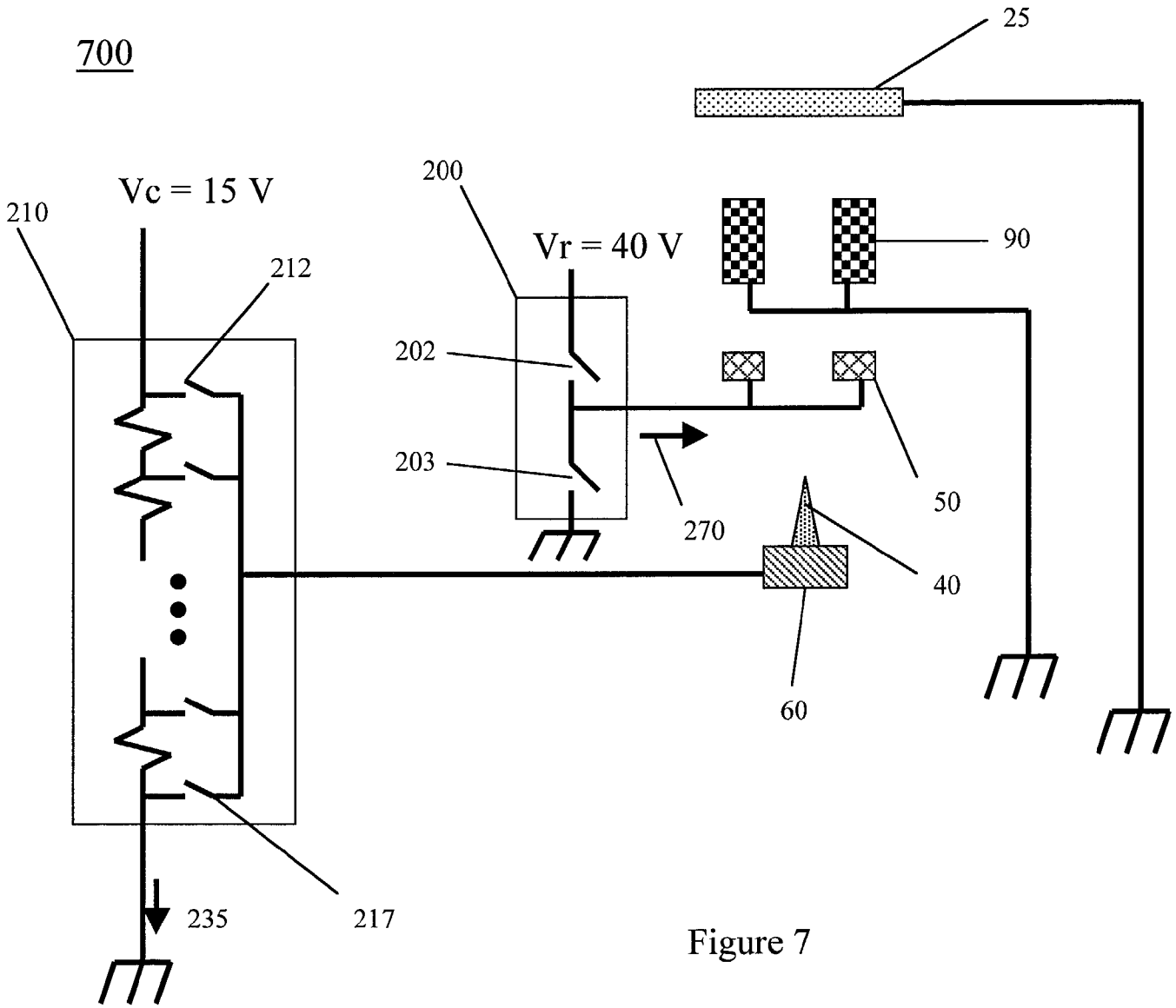
FIG. 7 is a schematic of a system utilized for measuring current through a gate in accordance within an embodiment of the present invention.

FIG. 7 is a schematic of a system 700 utilized for measuring current through a gate (e.g., 50) in accordance within an embodiment of the present invention. Within the present embodiment, the focus structure 90 and the anode 25 are both held at ground. It is appreciated that a ground potential coupled to anode 25 may be referred to as an anode driver. The gate current 270 flowing through the row driver 200 flows through the cathode 60/40 and exits as part of the column driver current 235. Therefore, one may measure the column driver current 235 or the row driver current. As with system 600 of FIG. 6, the voltages of system 700 of the present embodiment are much smaller than the typical voltages utilized in the anode 25, thus simplifying the current measurement process.

It is appreciated that since the column drivers (e.g., 210) and the row drivers (e.g., 200) are in parallel within the present embodiment, one may make a single current measurement for a group of sub-pixels (e.g., 80, 81 and 82). For example, all the sub-pixels (e.g., 80, 81 and 82) corresponding to a particular pixel may be activated at one time and a corresponding current measurement may be made. Additionally, small groups of pixels may be activated concurrently for a single current measurement.

In one embodiment of the present invention, the correction coefficient for a particular sub-pixel, pixel or group of pixels may be obtained from the current measurement made for that element by multiplying the current measurement by a scalar and adding a constant offset. The scalar and the constant offset may be determined through experimentation with the particular FED (e.g., 110).

In another embodiment in accordance with the present invention, the current measurements would be run through a two dimensional high pass filter in order to form the basis for computing the correction coefficient. It is understood that the high pass filter may remove the long range brightness variations (e.g., those greater than 1 centimeter) from the data. Additionally, the characteristics of the filter may be adaptively determined by means of a Fourier analysis of the current measurement data such that the corrected image will not have brightness variations in excess of the human discernible threshold at each spatial frequency.

Within an embodiment in accordance with the present invention, the current measurements may be fit to a low order two-dimensional polynomial, such as:

$$A+Bx+Cx^2+Dy+Ey^2+Fxy$$

where "x" and "y" are the pixel coordinates. The correction coefficient for a particular pixel may be the reciprocal of the value of the polynomial.

In an embodiment in accordance with the present invention, the current measurement may be adjusted for localized anomalies arising from the interaction of electrons with the internal support structures. The current measurements for a pixel may be adjusted for the pixel's proximity to internal support structures.

It is understood that in addition to any of the current measurement techniques described herein, a cathode driver (e.g., 210), gate driver (e.g., 200) or anode driver (e.g., 250) may deliver a signal that is analogous to its output current. For example, the delivered signal may be a variable DC voltage or a pulse train. As such, the signal delivered by the cathode driver (e.g., 210), gate driver (e.g., 200) or anode driver (e.g., 250) may also be utilized to determine its output current in accordance with an embodiment of the present invention. Consequently, the current measurement may be utilized in any manner similar to that described herein.

Figure 8:
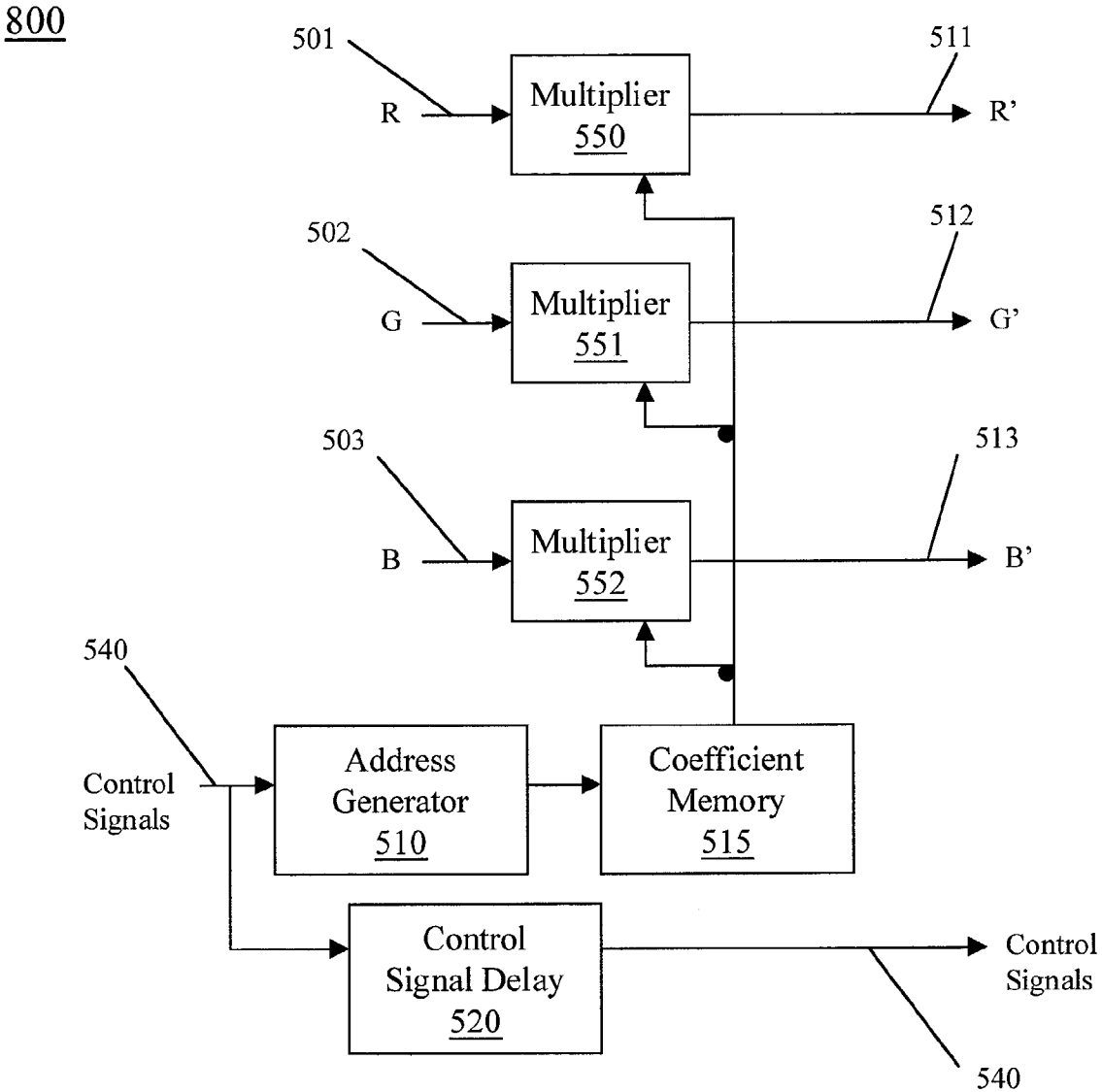
FIG. 8 is a block diagram of a correction system that uses a single correction coefficient for a Red-Green-Blue video signal in accordance within an embodiment of the present invention.

FIG. 8 is a block diagram of a correction system 800 that uses a single correction coefficient for a Red-Green-Blue video signal in accordance within an embodiment of the present invention. Specifically, system 800 is an exemplary architecture for an embodiment of the correction system 105 of FIG. 1. Within the present embodiment, a digital value for the red, green and blue components of a pixel are received via video inputs 501, 502 and 503, respectively. Furthermore, control signals 540 contain information to indicate the particular pixel in a frame. Within the present embodiment of correction system 800, the control signals 540 may include a clock, a first line marker and a line pulse. It is appreciated that the clock may tick once for every pixel in the frame while the line pulse may tick once at the beginning of a line. Furthermore, the first line marker may tick once for the first line in a frame. Additionally, within another embodiment of the control signals 540, a data enable signal may also be provided to indicate that the current pixel data is valid.

The address generator 510 of FIG. 8 uses the control signals 540 in order to compute an address for each pixel in the frame. The address is subsequently used in the coefficient memory 515 in order to obtain the correction coefficient for that pixel. The correction coefficient is then provided by the coefficient memory 515 to multipliers 550, 551 and 552 in order to scale the intensity values for each color component. Then multipliers 550, 551 and 552 provide the corrected color component to the display system 110 via video outputs 511, 512 and 513, respectively. Within the present embodiment, the multipliers 550–552, the address generator 510 and the coefficient memory 515 may be pipelined in order to improve throughput. The control signal delay unit 520 of the present embodiment is used to retard the control signals 540 in order to compensate for any pipeline delay introduced in the other parts of the correction system 105.

Figure 9:
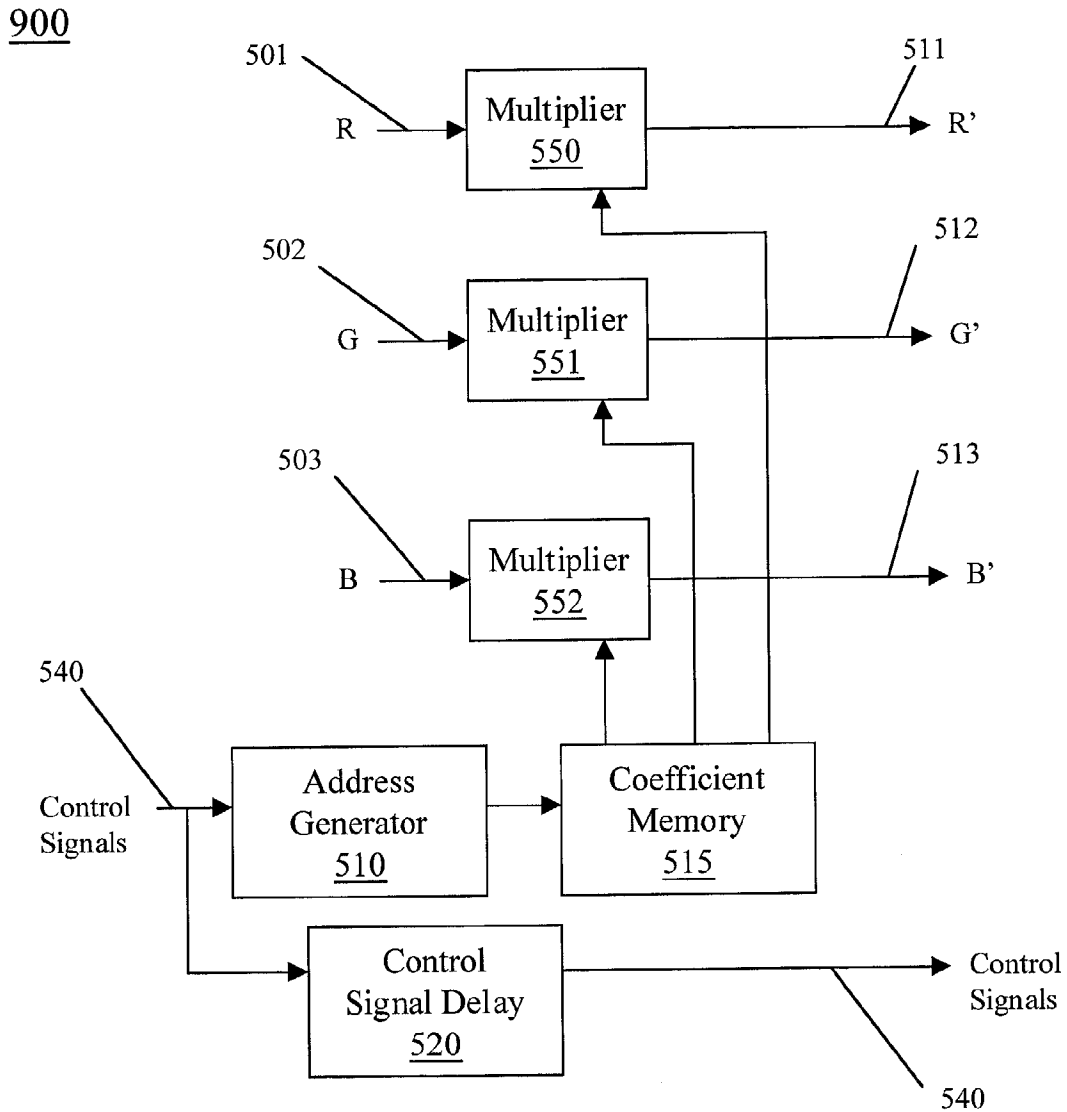
FIG. 9 is a block diagram of a correction system that uses a correction coefficient for each component of a Red-Green-Blue video signal in accordance with an embodiment of the present invention.

FIG. 9 is a block diagram of a correction system 900 that uses a correction coefficient for each component of a Red-Green-Blue video signal in accordance with an embodiment of the present invention. Specifically, system 900 is another embodiment of an exemplary architecture for correction system 105 of FIG. 1. In system 900 of FIG. 9, the coefficient memory 515 provides a separate correction coefficient for each color component of a pixel. It is appreciated that multipliers 550–552, video inputs 501–503, video outputs 511–513, address generator 510, control signals 540, and control signal delay 520 of correction system 900 operate in a manner similar to correction system 800 described herein with reference to FIG. 8.

In one embodiment in accordance with the present invention, the corrected value is used to set the voltage level in a column driver 210. In another embodiment, the corrected value is used to determine the duration of time that the current is produced by the column driver 210.

Figure 10:
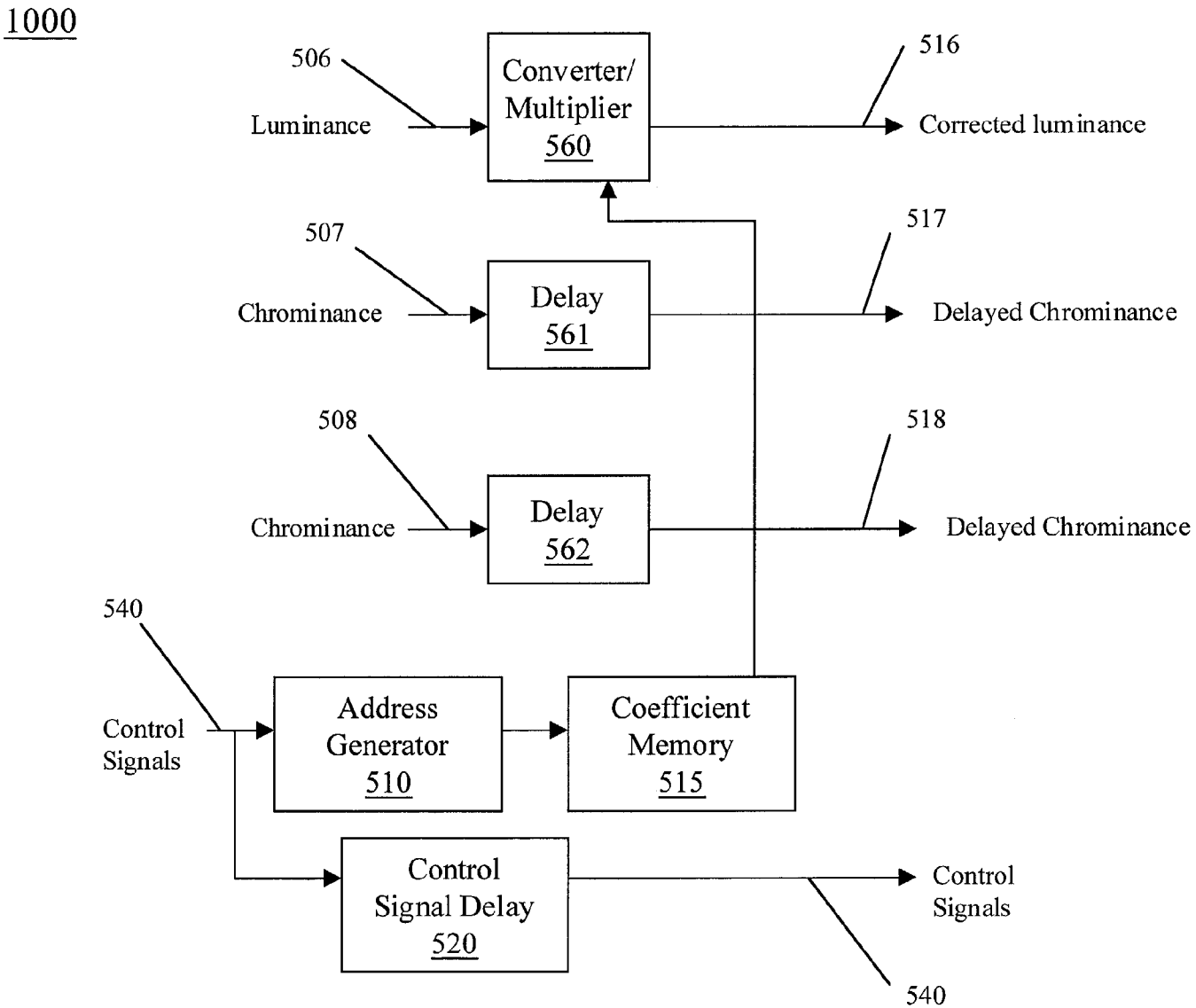
FIG. 10 is a block diagram of a correction system for an analog chrominance/luminance signal in accordance within an embodiment of the present invention.

FIG. 10 is a block diagram of a correction system 1000 for an analog chrominance/luminance signal in accordance within an embodiment of the present invention. Specifically, system 1000 is another embodiment of an exemplary architecture for correction system 105 of FIG. 1. System 1000 of FIG. 10 receives analog video information in the form of a chrominance-luminance signal (e.g., 506–508). The corrected analog data is used to drive a cathode ray tube (CRT), e.g., 110. Within system 1000, the luminance component (e.g., 506) may be the component scaled by the correction coefficient. For example, a converter/multiplier 560 converts the correction coefficient to an analog value and an analog multiplier is used to multiple the input luminance signal 506 by the analog correction coefficient in order to produce the corrected luminance signal 516. Additionally, the output chrominance signals 517 and 518 are delayed by delays 561 and 562, respectively, in order to maintain their synchronization with the corrected luminance signal 516.

Figure 11:
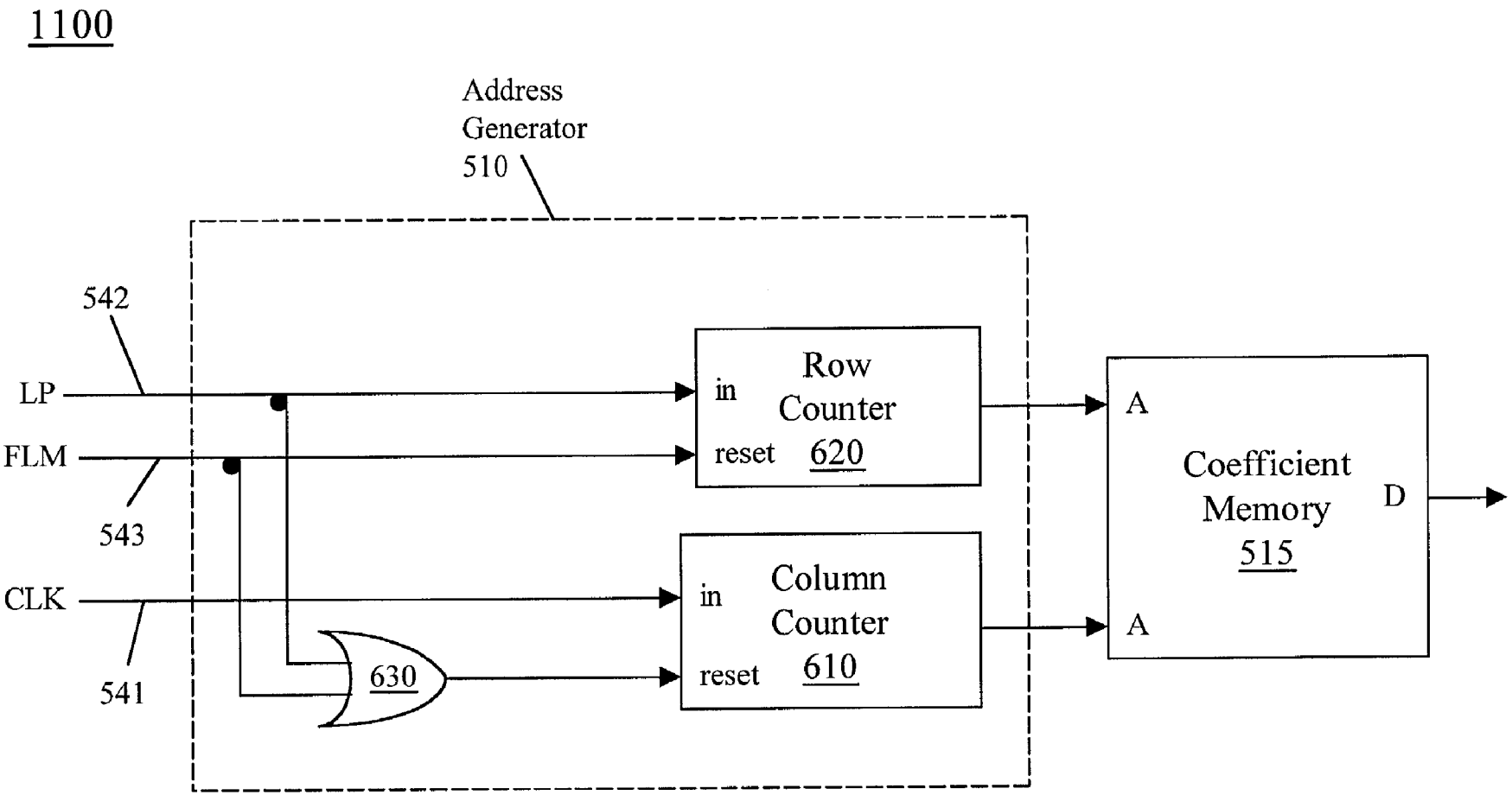
FIG. 11 is a diagram of an exemplary system of an address generator and a coefficient memory in accordance within an embodiment of the present invention.

FIG. 11 is a diagram of an exemplary system 1100 of an address generator (e.g., 510) and a coefficient memory (e.g., 515) in accordance within an embodiment of the present invention. Specifically, system 1100 shows an embodiment of the address generator 510 coupled to the coefficient memory 515. It is appreciated that pixels may be grouped into a frame and that the pixels may arrive in row by row sequence. Within the present embodiment, a first line marker (FLM) signal 543 is used to indicate the start of a frame of pixels. Additionally, it resets column counter 610 and row counter 620 to point at the beginning of an array of correction coefficients. A clock (CLK) signal 541 ticks once for every pixel. Furthermore, clock signal 541 advances the column counter 610. At the start of every line, the line pulse (LP) signal 542 ticks once which resets the column counter 610 and advances the row counter 620. The counter values are concatenated together in order to form the address for the coefficient memory 515. It is understood that the correction coefficient for each pixel may be stored within coefficient memory 515 in a location corresponding to that pixel's row and column within the frame. In an alternate embodiment, three parallel memories may be used for coefficient memory 515 in order to provide separate coefficients for the different color components of each pixel.

Within system 1100 of FIG. 11, it is appreciated that the column counter 610 may receive the line pulse signal 542 and the first line marker signal 543 via an output of an OR gate 630. Specifically, the OR gate 630 of the present embodiment is coupled to receive both the line pulse signal 542 and the first line marker signal 543.

Additionally, the OR gate 630 is coupled to output each of these signals to the reset input of the column counter 610. In this manner, the line pulse signal 542 and/or the first line marker signal 543 is able to reset the column counter 610.

Figure 12:
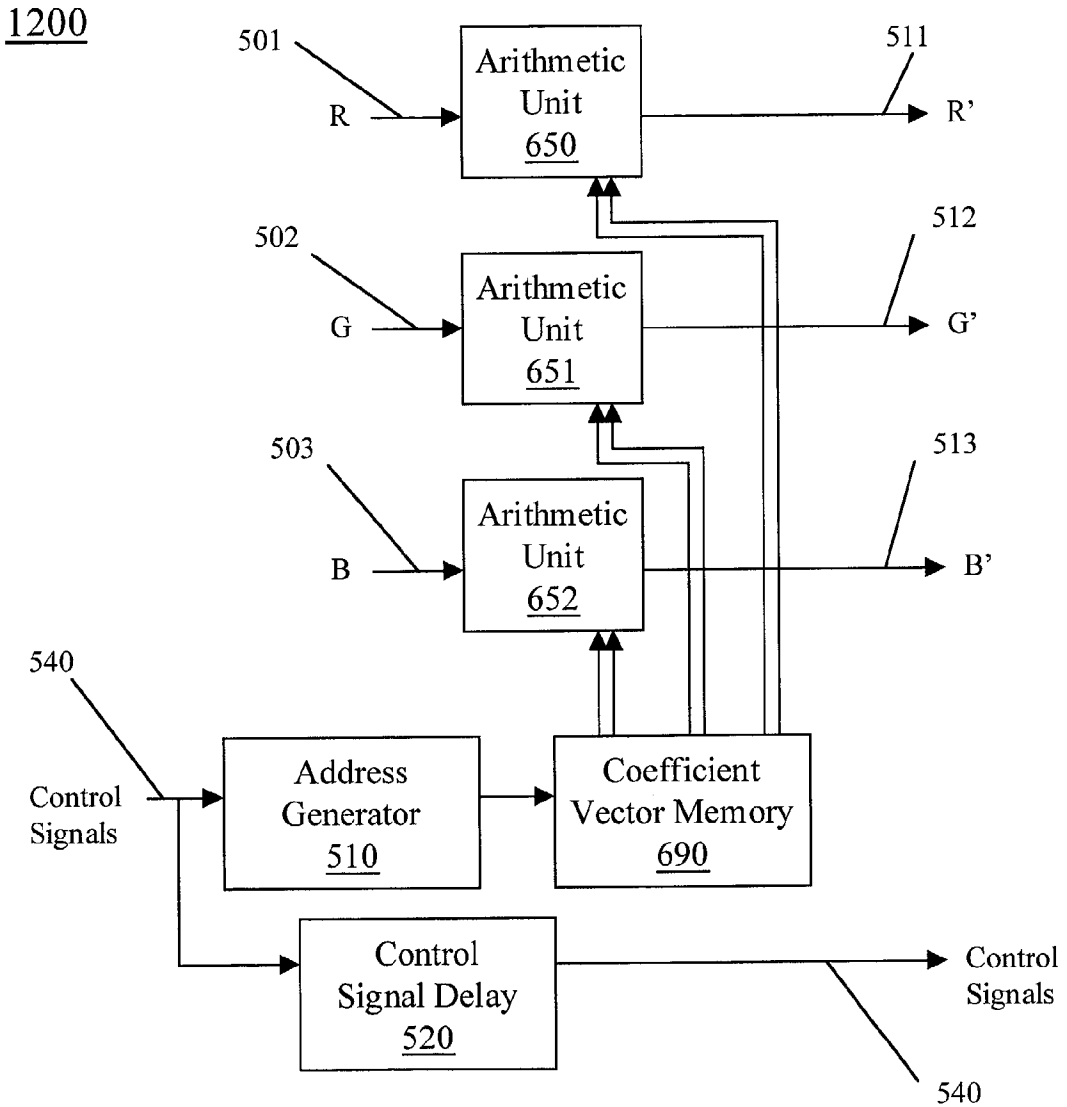
FIG. 12 is a block diagram of a correction system that uses several correction coefficients for each component of a Red-Green-Blue video signal in accordance with an embodiment of the present invention.

FIG. 12 is a block diagram of a correction system 1200 that uses several correction coefficients for each component of a Red-Green-Blue video signal in accordance with an embodiment of the present invention. Specifically, system 1200 is an embodiment of an exemplary architecture for correction system 105 of FIG. 1. As shown in FIG. 12, a coefficient vector memory 690 delivers several coefficients to each arithmetic unit 650, 651 and 652. Each one of the arithmetic units 650–652 computes a corrected value from the component value received via the video input (e.g., 501, 502 or 503) and the delivered coefficients. Within the present embodiment, two coefficients may be delivered and the corrected value may be computed as one coefficient plus the component value times the other coefficient. In another embodiment of system 1200, N coefficients may be delivered and the corrected value may be computed as a polynomial of degree (N−1).

Figure 13:
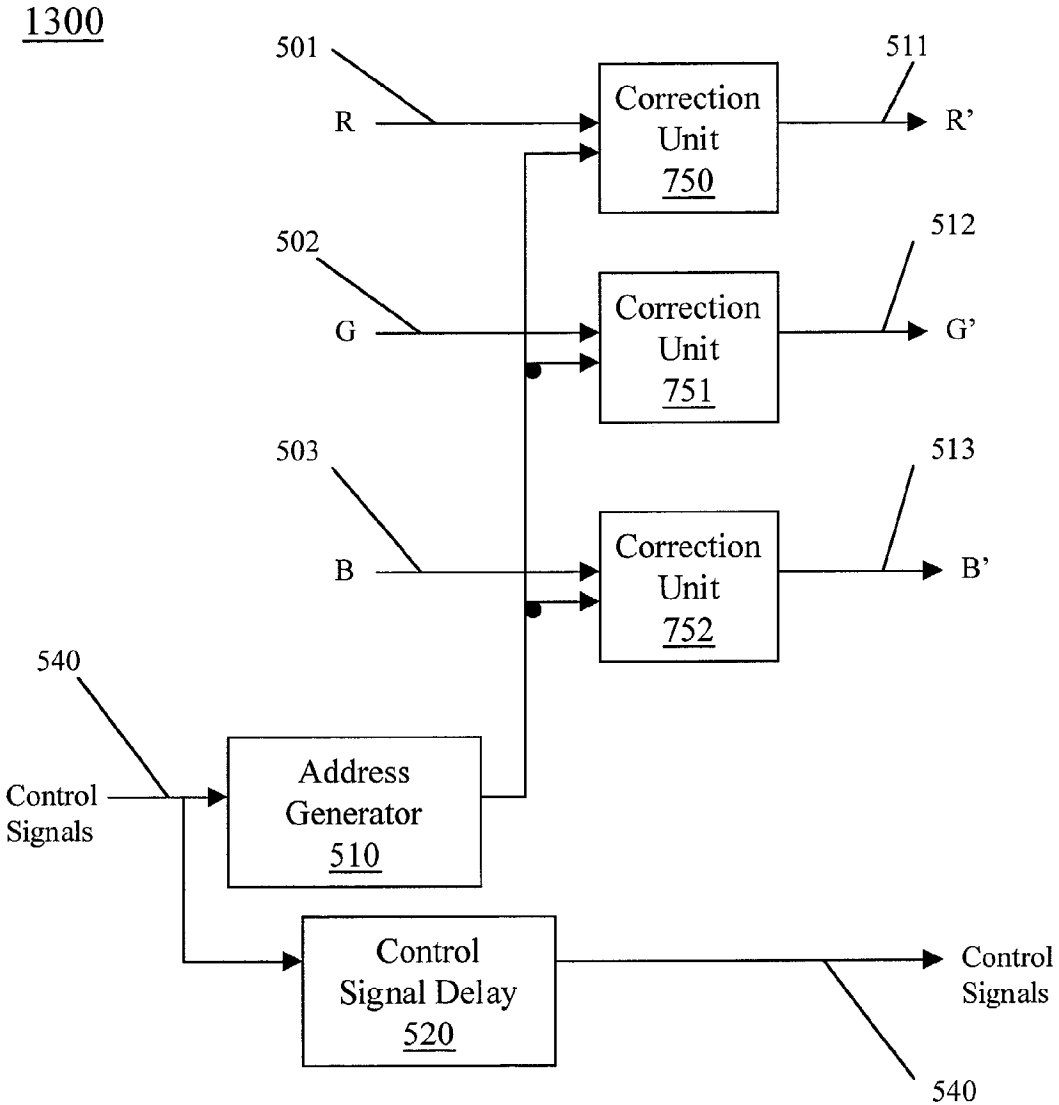
FIG. 13 is a block diagram of a correction system that uses a look-up table for each component of a Red-Green-Blue video signal in accordance with an embodiment of the present invention.

FIG. 13 is a block diagram of a correction system 1300 that uses a look-up table for each component of a Red-Green-Blue video signal in accordance with an embodiment of the present invention. Specifically, system 1300 is an embodiment of an exemplary architecture for correction system 105 of FIG. 1. Within the present embodiment of system 1300, correction units 750, 751 and 752 may each be implemented as a look-up table that utilizes the component value received via the video input (e.g., 501, 502 or 503) and the pixel address provided by the address is generator 510. For example, a look-up table may store the corrected value corresponding to that component value at that pixel. It is appreciated that this type of look-up table permits the implementation of any function that may fit within the available table space.

Accordingly, the present invention provides a system and method for measuring and correcting the non-uniform pixels of a display device without relying on external optical equipment and/or making measurements at higher operating voltages.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A display, comprising:

a plurality of sub-pixels arranged in a matrix of multiple rows and columns;

a plurality of row drivers;

a plurality of column drivers;

a plurality of row driver lines, each connected to a respective one of said plurality of row drivers to drive a respective said row of sub-pixels;

a plurality of column driver lines each connected to a respective one of said plurality of column drivers to drive a respective said column of sub-pixels; and a memory for storing correction coefficients for correcting a video signal, the correction coefficients computed on the basis of removing a long range variation from the brightness obtained when activating said plurality of sub-pixels.

2. A display according to claim 1, further comprising:

a current measurement device;

a line commonly connecting said current measurement device and each of said plurality of column drivers; and a computation system for producing the correction coefficients on the basis of a measurement result obtained by said current measurement device when a test input pattern that activates only one or more first predetermined sub-pixels of said plurality of sub-pixels is input and a measurement result obtained by said current measurement device when a test input pattern that activates only one or more sub-pixels other than said first predetermined sub-pixels is input.

3. A display according to claim 1, further comprising:

a current measurement device;

a line commonly connecting said current measurement device and each of said plurality of column drivers;

a computation system for producing the correction coefficients determined on the basis of measurement results by said current measurement device; and a multiplier for multiplying a signal by said correction coefficient, said signal multiplied by said multiplier being supplied to said column drivers.

* * * * *